US010590930B2

(12) United States Patent
Brandt et al.

(10) Patent No.: US 10,590,930 B2
(45) Date of Patent: Mar. 17, 2020

(54) SYSTEM FOR CONVEYING A MEDIUM

(71) Applicant: ITT Bornemann GmbH, Obernkirchen (DE)

(72) Inventors: Jens-Uwe Brandt, Rinteln (DE); Joerg Lewerenz, Nienstaedt (DE); Marco Bredemeier, Niedernwoehren (DE)

(73) Assignee: ITT Bornemann GmbH, Obernkirchen (DE)

( * ) Notice: Subject to any disclaimer, the term of this patent is extended or adjusted under 35 U.S.C. 154(b) by 0 days.

(21) Appl. No.: 15/527,088

(22) PCT Filed: Nov. 19, 2015

(86) PCT No.: PCT/EP2015/077108
§ 371 (c)(1),
(2) Date: May 16, 2017

(87) PCT Pub. No.: WO2016/079241
PCT Pub. Date: May 26, 2016

(65) Prior Publication Data

US 2018/0283374 A1 Oct. 4, 2018

(30) Foreign Application Priority Data

Nov. 20, 2014 (DE) ..... 10 2014 017 075

(51) Int. Cl.
*F04C 11/00* (2006.01)
*F04C 14/26* (2006.01)
(Continued)

(52) U.S. Cl.
CPC ..... *F04C 11/001* (2013.01); *F04C 2/16* (2013.01); *F04C 14/26* (2013.01); *F04C 15/008* (2013.01); *F01C 1/16* (2013.01); *F04C 2240/40* (2013.01)

(58) Field of Classification Search
CPC ..... F04C 11/001; F04C 11/003; F04C 2/16; F04C 15/008; F04C 23/001; F04C 28/02; F04B 25/00; F04B 41/06; F25B 1/10
(Continued)

(56) References Cited

U.S. PATENT DOCUMENTS 1,433,733 A * 10/1922 Lindsay ..... F04C 11/003 184/31
2,102,140 A 12/1937 Ungar
(Continued)

FOREIGN PATENT DOCUMENTS

CN 203642548 U 6/2014
DE 2119475 A1 11/1972
(Continued)

OTHER PUBLICATIONS

English translation of JP-04314990 by J-PlatPat Jul. 17, 2019.*
(Continued)

*Primary Examiner* — Deming Wan
(74) *Attorney, Agent, or Firm* — Moritt Hock & Hamroff LLP; Bret P. Shapiro

(57) ABSTRACT

The application relates to a system for conveying a medium having not less than two working machines (2, 2*a*, 2*b*, 2*c*) that each have not less than one carrier shaft (25, 35) with transport elements (22, 32) for the medium to be conveyed arranged on them, and not less than one drive (3, 3*a*, 3*b*, 3*c*) that sets the respective carrier shaft (25, 35) in rotation, with multiple working machines (2, 2*a*, 2*b*, 2*c*) connected in series, so that the medium is conveyed to a working machine (2, 2*a*, 2*b*, 2*c*) arranged downstream, and so that a separate drive (3, 3*a*, 3*b*, 3*c*) is assigned to each of the working machines (2, 2*a*, 2*b*, 2*c*) and that the drives (3, 3*a*, 3*b*, 3*c*) are connected in parallel with each other and connected to a common power supply system (5).

18 Claims, 3 Drawing Sheets

Figure 1:
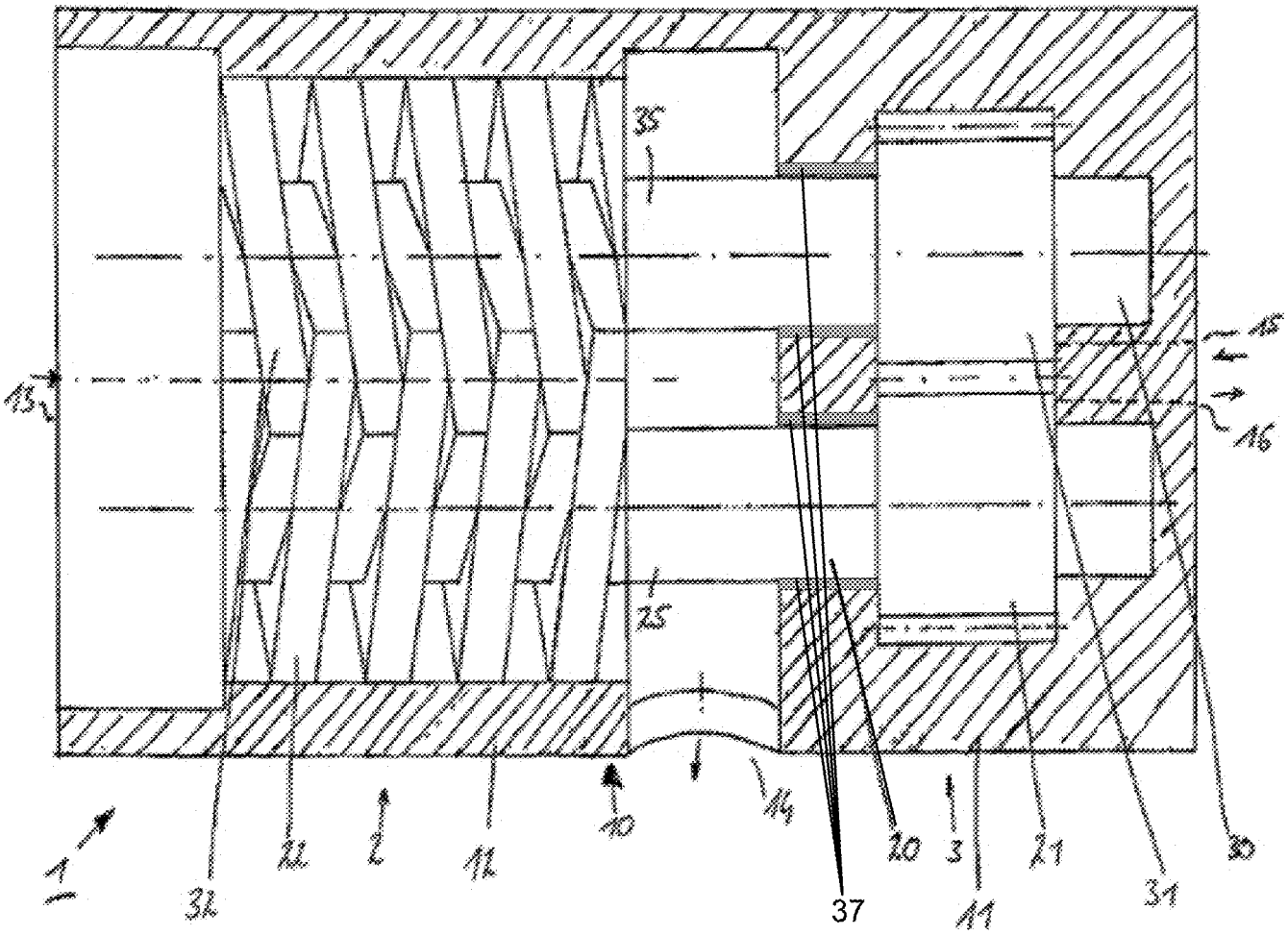

(51) Int. Cl.

| | |
|---|---|
| ***F04C 23/00*** | (2006.01) |
| ***F25B 1/10*** | (2006.01) |
| ***F04C 2/16*** | (2006.01) |
| ***F04C 15/00*** | (2006.01) |
| *F01C 1/16* | (2006.01) |

(58) Field of Classification Search
USPC ..... 417/338; 418/39
See application file for complete search history.

(56) References Cited

U.S. PATENT DOCUMENTS

| | | | | |
|---|---|---|---|---|
| 2,970,641 | A * | 2/1961 | Rosen | B64D 37/16 137/118.04 |
| 3,184,155 | A | 5/1965 | Crooks | |
| 3,859,815 | A | 1/1975 | Kasahara | |
| 4,068,984 | A * | 1/1978 | Spindler | F04C 18/16 418/199 |
| 5,263,832 | A * | 11/1993 | Yamaguchi | F04C 29/04 418/83 |
| 5,846,062 | A * | 12/1998 | Yanagisawa | F04C 18/16 417/410.4 |
| 9,103,342 | B2 | 8/2015 | Jaeschke et al. | |
| 2003/0044299 | A1 | 3/2003 | Thomas et al. | |
| 2009/0047142 | A1 | 2/2009 | Hozumi et al. | |
| 2009/0277215 | A1* | 11/2009 | Tsuboi | F04C 18/16 62/498 |
| 2009/0304522 | A1 | 12/2009 | Lelong et al. | |
| 2011/0064592 | A1 | 3/2011 | Jaeschke et al. | |
| 2012/0260693 | A1* | 10/2012 | DeMore | F04B 35/04 62/644 |
| 2014/0099225 | A1 | 4/2014 | Denny | |

FOREIGN PATENT DOCUMENTS

| | | | | |
|---|---|---|---|---|
| DE | 41 21 684 | | 1/1993 | |
| DE | 10 2008 018 407 | A1 | 10/2009 | |
| JP | 04314990 | A * | 11/1992 | F04C 23/001 |
| RU | 98497 | U1 | 10/2010 | |
| RU | 2498113 | C2 | 11/2013 | |

OTHER PUBLICATIONS

DE10 2008 018 407A1 corresponds to US20110064592A1.
English Language Abstract of DE 41 21 684.
English language Abstract of CN203642548U.
English language Abstract of DE2119475A1.

* cited by examiner

SYSTEM FOR CONVEYING A MEDIUM

The invention relates to a system for conveying a medium having not less than two working machines each having not less than one carrier shaft, on which transport elements for transporting the medium to be conveyed are arranged, and not less than one drive that sets the respective carrier shaft in rotation.

Working machines, e.g. displacement pumps with multiple shafts, are usually driven by a single drive, e.g. a hydraulic engine, internal combustion engine or an electric motor that is connected to the driven shaft of the working machine either directly or by means of a coupling and/or a gear drive. An embodiment with an electric motor as drive is, for example, described in DE 10 2008 018 407 A1.

In case of working machines with multiple shafts that depend on the angle of rotation and function according to the positive displacement principle, a load distribution between the individual shafts is required, which creates additional high forces and bending moments within the working machine. Moreover, there is also a need for synchronization between the shafts that depend on the angle of rotation.

The objective of the present invention is to provide a system that makes it possible to raise the attainable differential pressure and enables a simple adjustment of the conveying characteristics when conveying a multiphase blend with compressible and incompressible media.

This objective is met by a system according to the invention with the characteristics of the main claim. Advantageous configurations and additional embodiments of the invention are disclosed in the dependent claims, the written description and in the figures.

The system for conveying a medium having not less than two working machines that each have not less than one carrier shaft with transport elements for the medium to be conveyed arranged on them, and not less than one drive that sets the respective carrier shafts in rotation, is designed in such a way that multiple working machines are connected in series, so that the medium is conveyed to a working machine arranged downstream, and so that a separate drive is assigned to each of the working machines and that the drives are connected in parallel with each other and connected to a common power supply system.

The power supply system may be a local power supply system, such as a decentralized electricity generating facility, a pump that provides hydraulic fluid or a mechanical drive equipment. By connecting the working machines in series and supplying the medium that is coming out of a working machine as inlet medium into the next working machine that is arranged downstream, it is possible to raise the total conveying capacity and the feed pressure. Coupling the working machines that are connected in series to a common power supply system, not only couples the fluid flows, but simultaneously the energy flows of the individual drives as well, wherein, due to the parallel connection of the drives with regard to the power supply, a separate control for this is not required. The system consisting of multiple working machines automatically adjusts to the respective conveying requirements, because the respective drives are connected in parallel to each other and connected to a common power supply system. Depending on the load of the working machine, the required amount of energy is supplied to the respective drive out of the common energy reserve of the power supply system, without requiring any further control.

The working machine and the drive may be installed in a common housing, resulting in a modular design of the system. Every working machine may be assigned to precisely one drive, so that individual assembled modules with one working machine and one drive can be provided. Any number of working machines and drives may be linked with each other, enabling an easy modular manufacture along with correspondingly easy arrangement and coupling of multiple modules one to the other.

For enhanced performance and easier installation, it is possible to connect several working machines mechanically to form one module, so that a stable connection of the working machines to each other can be achieved, which is particularly applicable when using the system for conveying hydrocarbons in bore holes. The modules may likewise be mechanically connected to each other, wherein the working machines and/or the modules consisting of connected working machines may be linked directly adjacent to each other, in order to achieve a compact design.

By means of linking the working machines together into modules and by combining several modules with each other, adjustments to the conveying conditions can easily be made. If modules are combined with each other and fluidically connected in series, all the modules may either be connected in parallel regarding the power supply of the drives, or each module consisting of several working machines may be separately supplied with power, whereby the drives within the module are connected in parallel to each other as far as the power supply is concerned.

A further development of the invention is designed in such a way that two working machines are connected with each other by way of connecting elements, which connect an outlet of one working machine with an inlet of a working machine arranged downstream. Thus, in addition to the mechanical connection of the working machines, a medium flow from the outlet of one working machine arranged upstream to the inlet of another working machine arranged downstream is simultaneously realized through the connecting element.

The working machine may be designed as a positive displacement pump, in particular as a screw spindle pump, which makes it possible to even convey multiphase blends that are supplied with different compositions of solid phase, liquid phase and gaseous phase. The phase fractions may change during the conveying period, so that at different points in time different proportions of solid phase, gaseous phase and liquid phase are present.

The drive of the respective motors may be designed as a hydraulic engine or an electric motor. In one configuration of the drive as a hydraulic engine, one embodiment of the invention is provided, in which the motor is to be a gear motor or a screw spindle motor. This basically allows the medium that is to be conveyed, possibly after a separation of the different phases, to be used also as a drive medium.

The number of the driven shafts of the drive may correspond to the number of the carrier shafts of the respectively assigned working machine. It is likewise possible for the number of the driven shafts to be an integer multiple of the number of the carrier shafts. If the number of the driven shafts of the drive corresponds to the number of the carrier shafts of the respectively assigned working machine, every carrier shaft is individually driven by a driven shaft. The working machine, usually a pump, has two or more carrier shafts with transport elements, such as gears or screw spindles, arranged on them. The drive sets the carrier shafts in rotation, so that the transport elements transport the medium to be conveyed through the housing or conveying chamber from an inlet to an outlet. Instead of using a single-shaft drive to drive a multi-shaft working machine over a single drive spigot along with a respective coupling element, e. g. a gear wheel for synchronizing the respective carrier shafts, the drive is realized through multiple driven shafts that drive the individual shafts of the working machine that are coupled with each other in an angle-dependent and rigid manner. Thus, the proportionate drive torque is evenly induced into every individual carrier shaft, which avoids the drive torque being induced through the driven shafts into the other driven shafts. This results in significantly reduced torsion moments and bending moments in the shafts, particularly in that shaft through which the drive torque is being induced. When the number of driven shafts of the drive corresponds to the number of the carrier shafts, the induced loads are significantly reduced, or evenly distributed in the shafts, which as a result significantly extends the expected lifespan of the working machine. In turn, the dimensions of the shafts, bearings and seals may be reduced respectively. If integral multiples of driven shafts are assigned to the respective carrier shafts, for example two or more, the individual load that is transferred to the carrier shaft is reduced, as the loads are advantageously applied evenly in proportion to the circumference onto the carrier shaft. This leads to a further reduction of the peak loads and thus to an extension of the lifespan of the working machine.

The respective working machine may have multiple carrier shafts and the respective drive may have multiple driven shafts that are each coupled with a carrier shaft. Due to the clear assignment of the carrier shafts to the driven shafts, a precise coupling of the carrier shafts in relation to each other and of the driven shafts in relation to the respective carrier shafts may be achieved, which makes a simple modular wiring of multiple working machines with each other possible.

Preferably, the working machine has multiple carrier shafts that are coupled with each other in an angle-dependent and rigid manner, so that in an embodiment as a gear pump or a screw spindle pump, very compact working and driving machine units can be realized that can be advantageously used under restricted spatial conditions, such as those found, for example, on oil production and gas extraction platforms. The driven shaft can be part of the carrier shaft or coupled with it in a rigid manner. In case of a rigid coupling, the driven shaft and the carrier shaft can be separated during maintenance work and replaced separately, for example, if the carrier shaft displays higher wear due to abrasive media.

The drive and the working machine may be hydraulically decoupled from each other, so that the medium to be conveyed is separated from the drive. Thus, the drive can be designed independently of the medium to be conveyed. If, for example, a separate hydraulic fluid is used, a mixing of the respective fluids is avoided by the hydraulic decoupling of the drive from the working machine. It is likewise possible to use non-hydraulic drives that are protected by the hydraulic decoupling from any fluid to be conveyed entering the drive.

Every working machine can have a bypass line assigned to it, in order to be able to circumvent the respective working machine in the series connection. The bypass line makes it possible to switch off the respective working machine in the conveying line, so that, in case of damage or wear, the working machine can be replaced without having to interrupt the conveying process and with the possibility of continuing the process with a reduced performance. Depending on the design of the system, it is likewise possible that regardless of the bypass and breakdown of one working machine, the conveying process can be continued without any impairment. To that end, it is advantageous for the system to be overdimensioned with regard to the necessary working machines connected in series, so that one or more working machines can be switched off for maintenance or repair. Additionally, the bypass makes it possible to provide spare working machines that are normally not in operation, but are only used to take over the conveying task of another machine, when a working machine breaks down. Moreover, the possibility of opening and closing the bypass lines provides an option to react to changed operating conditions, so that individual working machines may be added or switched off, depending on the existing requirements, allowing to resume conveying or to raise or lower the pressure accordingly.

The supply lines for the drives may be integrated in the respective drive housings, so that separate lines or line routing outside the drive housings is avoided.

Figure 2:
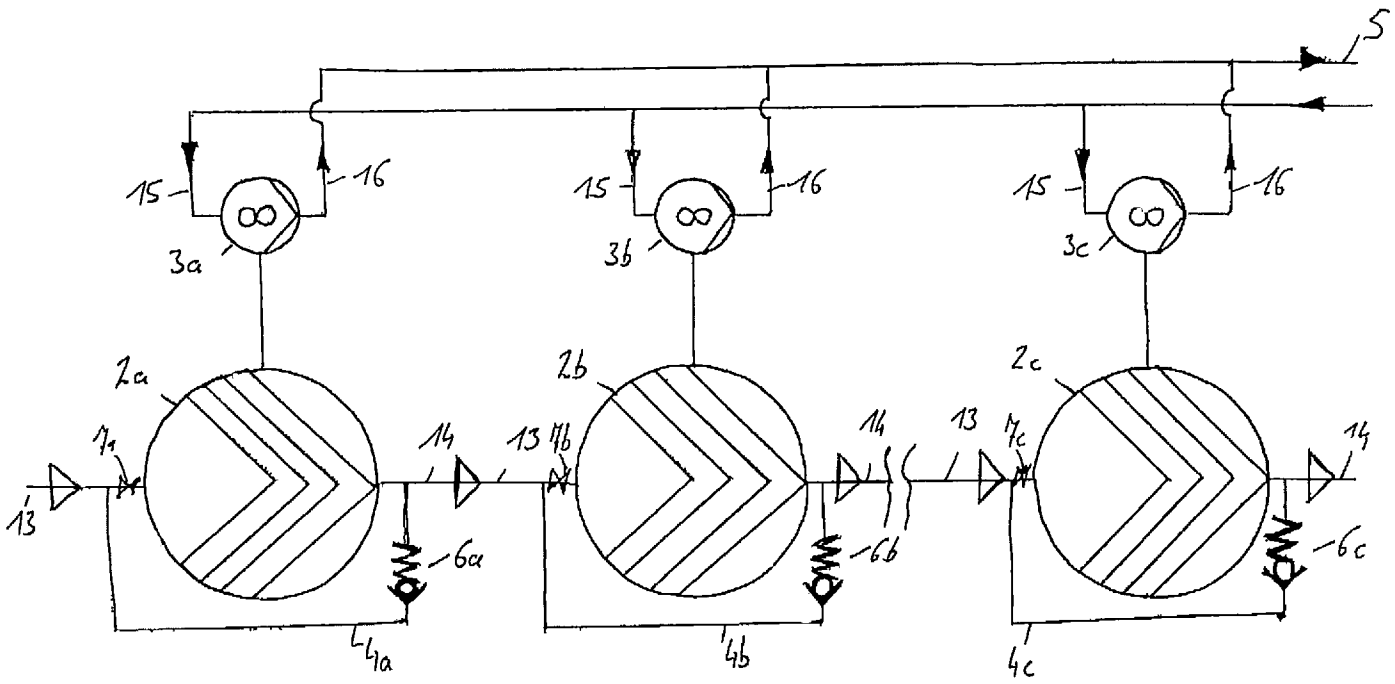
Figures 3, 4:
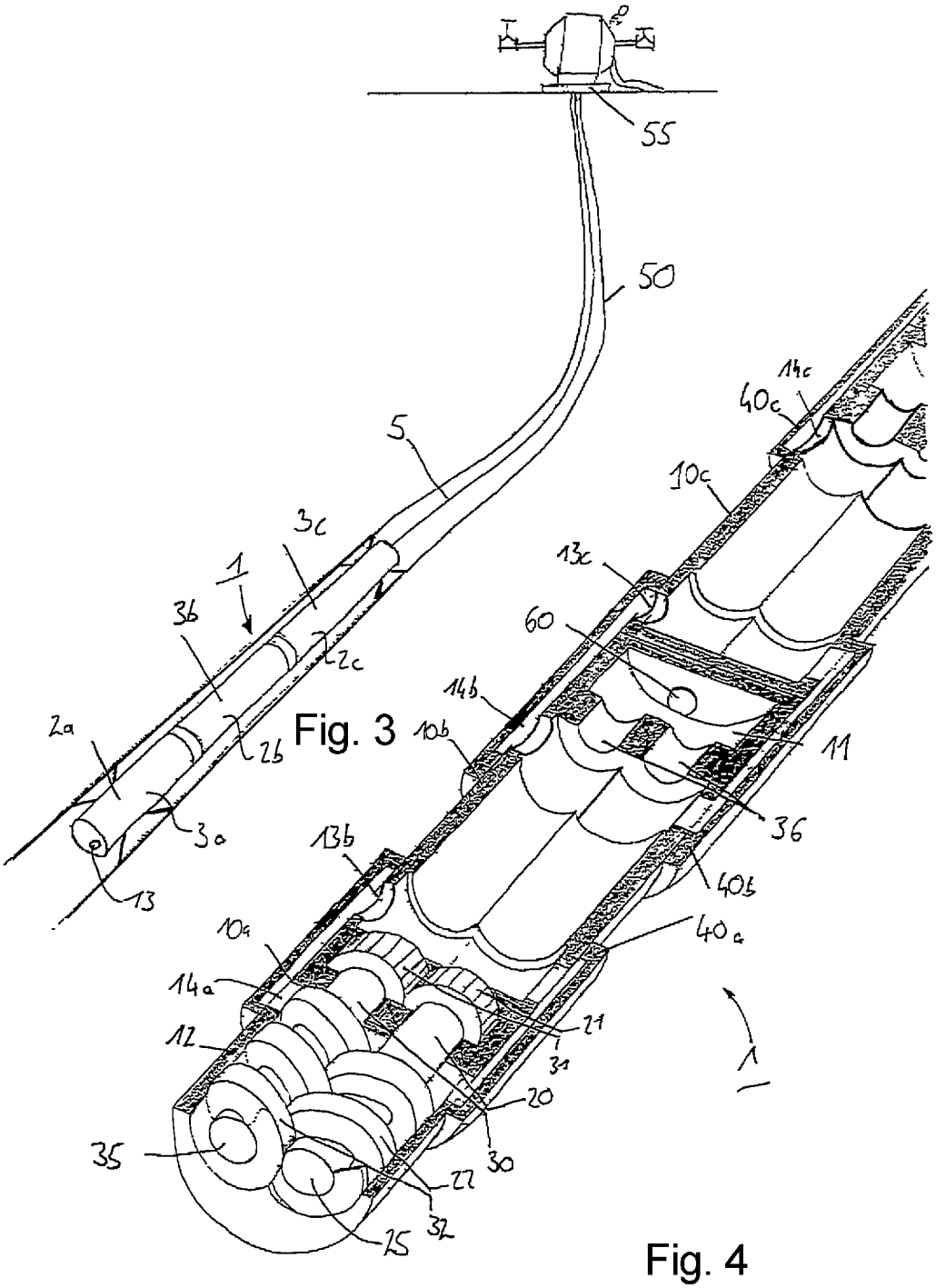

One embodiment of the invention is described below with reference to the attached figures. What is depicted is:

FIG. 1 a schematic sectional view of a working machine with a drive;

FIG. 2 a schematic representation of the wiring of the drives;

FIG. 3 a schematic representation of an application example; and

FIG. 4 a detailed sectional view of an arrangement according to FIG. 3.

In the sectional view of FIG. 1, one part of the system 1 with a housing 10 is shown, in which a working machine 2 and a drive 3 are located. The working machine 2 is designed as a screw spindle pump with two spindles and is located in a working machine housing section 12 of the housing 10. The drive 3 is located in a drive housing section 11 of the housing 10 and is designed as a twin-shaft hydraulic gear motor in the depicted embodiment example.

In the housing 10 an inlet 13 for the medium to be conveyed is provided, through which the medium to be conveyed, such as hydrocarbons in oil production or gas extraction can find their way into the working machine 2. From the inlet 13, the medium to be conveyed is transported by means of the transport elements 22, 32 in the shape of worm threads through the working machine 2 to the outlet 14.

The transport elements 22, 32 are mounted on the carrier shafts 25, 35 or designed as part of them, and they convey the medium from the inlet 13 to the outlet 14. The carrier shafts 25, 35 penetrate the inlet area behind the inlet 13 and extend into the drive housing 11, so that they can be coupled with the driven shafts of the drive 3 in a torsionally rigid manner.

The drive 3 is arranged in the drive housing section 11 in the form of a hydraulic gear motor that is supplied with pressurized hydraulic fluid via an inlet channel 15. Through the inlet channel 15, the hydraulic fluid is supplied to the pair of gears in mesh consisting of the gears 21 and 31. The gears 21, 31 are firmly fastened on the driven shafts 20 and 30 of the drive 3, e.g. shrunk or positively mounted, for example by means of a parallel key or a tooth system. The hydraulic fluid that is supplied via the inlet channel 15 to the drive 3 sets the gears 21, 31, and thus the driven shafts 20, 30, in rotation. The depressurized hydraulic fluid is removed via the outlet channel 16.

Instead of the shown design involving a gear motor, the drive 3 may likewise be designed as a screw spindle motor, in which the gearing of the driving components is achieved via screw spindles instead of gear teeth. In the depicted embodiment, the inlet channel 15 is arranged on the front side of the system 1 and allows the hydraulic fluid to flow in basically parallel to the rotation axis of the driven shafts 20, 30. The removal of the hydraulic fluid through the outlet channel 16 happens likewise on the front side in the opposite direction, i. e. also coaxial to the rotation axis of the driven shafts 20, 30. Thus, a space-saving design as well as an easy supply and an easy removal of hydraulic fluid from one side is achieved in a bore hole, drill pipes or in a conveying pipeline.

In the embodiment shown as an example, the driven shafts 20, 30 are designed in one piece with the carrier shafts 25, 35, so that the power supplied by the hydraulic engine is directly transmitted by the driven shafts 20, 30 of the drive 3 onto the carrier shafts 25, 35 of the working machine 2. As an alternative to the single-piece design of the driven shafts and the carrier shafts 20, 30, 25, 35, it is also possible that the driven shafts 20, 30 are coupled by means of a coupling device, such as a screwed flange, a coupling bushing or another rigid connection. It is also possible to couple the driven shafts 20, 30 with the carrier shafts 25, 35 in such a way that the angular position of the shafts 20, 25, 30, 35 to each other is maintained, for example by means of a gearing with a gear drive.

Instead of the single-piece design of the housing 10, where the working machine housing and the drive housing are combined and the overall housing is divided to allow installation of the device, a design involving multiple parts is likewise possible, particularly in such a way that the working machine housing 12 and the drive housing 11 are manufactured separately and attached to each other.

Provision may be made for the drive 3 and the working machine 2 to be hydraulically decoupled from each other, so that no medium to be conveyed reaches the drive 3 from the working machine 2, in order to avoid contamination and a corresponding higher wear of the drive. To that end, the opening for the driven shafts 20, 30 into the inlet area or suction area of the working machine 2 is sealed off, for example by means of labyrinth seals or shaft seals 37. However, if the device 1 is meant to be used for oil production, it may be advantageous for the hydraulic fluid to be compatible with the fluid to be conveyed, for example, to be appropriately reprocessed oil, as in such a case, a possible leakage in the seal would not result in pollution of the medium to be conveyed.

Placing the drive 3 and the working machine 2 in one housing 10 makes it possible to have a compact, and in particular a cylindrical design. It is possible to arrange multiple systems 1 in a row, one behind the other, and to connect them mechanically, so as to form one module. Such a consecutive arrangement of systems 1 has the advantage that the medium that is conveyed from the working machine 2 through the outlet 14 can be transported through a connecting channel to the inlet 13 of a following system. The hydraulic fluid that is being used to drive the drive 3 can thereby be conveyed through the housing of the system 1.

In a different embodiment from the shown example, it is also possible that two working machines 2 are coupled with one drive 3, so that the driven shafts 20, 30 of the drive 3 protrude from the drive housing 11 in both directions and are arranged on both sides of the gears 21, 31. In such a way, an even more compact design of the system 1 is possible. Both working machines 2 connected to such a drive 3 can transport the medium to be conveyed in the same direction. Alternatively, opposed transport directions can likewise be achieved with such a drive.

The carrier shafts 25, 35 of the transport elements 22, 32, or the screw conveyors, are rigidly coupled with each other in an angle-dependent way, whereby the coupling is achieved by the gears 21, 31 of the drive 3 due to the torsionally rigid connection between the driven shafts 20, 30 and the carrier shafts 25, 35. A further synchronization of the carrier shafts 25, 35 is not needed, a conveyance of moments through one of the carrier shafts is not necessary, which leads to a massive reduction of the load created by torsion moments and bending moments inside the shafts. In order to achieve more precise synchronization characteristics and synchronicity of the carrier shafts 25, 35 and thus of the transport elements 22, 32, it is possible and planned to arrange one or more meshing pairs of gears on the carrier shafts 25, 35 in addition to the gears 21, 31 of the drive 3, in order to ensure synchronicity. However, no driving power is induced by these synchronization gears, but only a more precise synchronization is achieved. Ideally, the driving power of the drive 3 is induced evenly into both carrier shafts 25, 35, which is due to the direct coupling between the driven shafts 20, 30 and the carrier shafts 25, 35, which ensures that every carrier shaft 25, 35 is driven individually. Through the individual coupling of a carrier shaft 25, 35 with a driven shaft 20, 30 of the drive 3, an automatic distribution of the load onto the individual shafts of a multi-shaft working machine 2 with a dependent angular position of the carrier shafts 25, 35 follows, whereby, in an advantageous arrangement, the working machine 2 is working according to the positive displacement principle. All shafts are automatically synchronized with each other. By minimizing additional loads, such as e.g. bending moments that result from gear tooth forces or from the torsion due to the conveyance of drive torques from one shaft onto the next, the occurring bending of the shafts is reduced, which opens the possibility of improving efficiency by reducing the inner tolerances within the transport elements. FIG. 2 shows a schematic representation of the drives connected in parallel and the working machines connected in series. In FIG. 2, three working machines 2*a*, 2*b*, 2*c* in the form of screw spindle pumps are depicted that are arranged in line one behind the other and connected in series. A medium such as, for example, a mix of hydrocarbons from a bore hole is fed into the working machine 2*a* that is on the left hand side of FIG. 2 via an inlet 13. The mix of hydrocarbons is usually a multiphase blend comprising a fluid part, a solid part as well as a gaseous part. The medium is fed through the working machine 2*a* towards the outlet 14 of the working machine 2*a* and from there to an inlet 13 of the next working machine 2*b* that is arranged downstream. From the second working machine 2*b*, the possibly compressed and higher pressurized medium is fed via the outlet 14 to the inlet 13 of the third working machine 2*c* that is again arranged further downstream, from where the medium is transported via the outlet 14 to the so called wellhead of the bore hole for removal. Each working machine 2*a*, 2*b*, 2*c* is equipped with a bypass line 4*a*, 4*b*, 4*c*, through which it is possible to feed the medium from the inlet 13 or even from before the inlet 13 to the outlet 14 behind the working machine 2*a*, 2*b*, 2*c*, thus bypassing the respective working machine 2*a*, 2*b*, 2*c*. Every bypass line 4*a*, 4*b*, 4*c* is equipped with a one-way valve 6*a*, 6*b*, 6*c*, so as to prevent the medium from flowing back from the outlet 14 to the inlet 13. The one-way valve 6*a*, 6*b*, 6*c* can be configured as a switchable, in particular as a spring-loaded switchable valve, in order to enable complete release of the bypass line 4*a*, 4*b*, 4*c*. Additionally, a stop valve 7*a*, 7*b*, 7*c* may also be assigned to each working machine 2*a*, 2*b*, 2*c*, in order to be able to completely block the passage through the working machine 2*a*, 2*b*, 2*c*. This makes it possible to exclude the complete working machine 2*a* from the conveying flow of the medium, for example, in order to perform maintenance work or to adjust the output or the conveying capacity.

Due to the fact that the bypass line is equipped with a one-way valve 6*a*, 6*b*, 6*c*, in case of a blockage, the affected conveying unit is automatically removed from the conveying process without disturbing it.

Furthermore, FIG. 2 shows that a separate drive 3*a*, 3*b*, 3*c* is assigned to every working machine 2*a*, 2*b*, 2*c*. In the depicted initial example the drive is designed to be a hydraulic engine. All drives 3*a*, 3*b*, 3*c* are supplied with energy from a common power supply system 5 with a supply line 15 and a return line 16. The supply line 15 and the return line 16 are both explained in FIG. 1, the common supply with energy and the connection in parallel of the power supply is schematically shown in FIG. 2. The respective drives 3*a*, 3*b*, 3*c* are connected with each other in series with regard to the energy supply, so that a firmly established hydraulic driving stream is supplied from the power supply system to each drive 3*a*, 3*b*, 3*c*, each of which is designed, for example, as a gear motor. As opposed to working machines that are wired in parallel, for which the load is automatically distributed depending on the size of the individual working machine, the wiring of multiple working machines 2*a*, 2*b*, 2*c* in series is significantly more sophisticated. In case of angle-independent or fluid-dynamic machines such as, for example, centrifugal pumps, this is economically achieved in practice by using a common drive. With the single-shaft or multiple-shaft working machines of the invention that function according to the positive displacement principle, the load distribution onto the involved units of the series connection is much more demanding. This applies in particular when the medium to be conveyed and pressurized within the process volume flow contains compressible parts. The compressible parts lead to a progressive pressure gradient over the individual units and result in a changed, in case of higher pressure—reduced, volume of the conveyed medium. With constant conveying conditions, this can be accounted for when designing the conveying characteristics of the respective following unit. Under real operating conditions, however, the conveying process is rarely constant, so that such a rigidly designed system would not be able to react to the changes, which is why intermediate pressures have to be controlled and the conveying characteristics of the following unit have to be promptly adjusted accordingly, for example by means of adjusting the rotational speed. As the changes of the conveying conditions occur very rapidly, the demands on the dynamic of adjusting the conveying characteristics of the following units are extremely high. According to the invention, however, the three pump units that are shown as an example, with the separate hydraulic gear motors 3*a*, 3*b*, 3*c* are all connected in parallel to a common supply system 5 that supplies the firmly established drive stream for driving the hydraulic engines 3*a*, 3*b*, 3*c*. With changing operating conditions, it may happen that one individual unit experiences a higher load than the following unit due to, for example, compressible parts being conveyed, so that its required drive torque increases, which, in turn, leads to a lower speed. Thus, less volume is realized with a hydraulic drive. This automatically results in a higher supply being available for the hydraulic drives of the neighboring units. They now adjust their respective speed to the new conditions, which, in turn, leads to the previously higher loaded unit to be relieved. The same applies, if, for example, one of the units starts showing increased wear. In such a case, the units that are arranged before and after it partially take over a share of the load at the limits of their respective operating ranges.

FIG. 3 shows a schematic representation of an application of the system in a bore hole 50, also called casing. The so-called wellhead 55 is arranged, at the upper end of the bore hole 50 The conveyed medium is removed from the former. Inside the bore hole 50, the power supply 5 as well as a return line for the conveyed process medium are provided for. The power supply 5 may be an electrical energy supply or can take the shape of a hydraulic drive, in order to realize the energy supply by means of a hydraulic pressure system that is integrated in the wellhead 55. It is quite easy to drive the respective drives 3*a*, 3*b*, 3*c* that are configured as hydraulic engines by using a pressure line 15 and a return line 16.

At the lower end of the bore hole 50, the system 1 with three modules is shown. The modules each consist of one working machine 2*a*, 2*b*, 2*c* and one drive 3*a*, 3*b*, 3*c*. The individual parts of the system are mechanically connected to each other and arranged one behind the other in the direction of the flow, so that the medium is conveyed from the bore hole 50 through the inlet 13 of the front working machine 2*a* to flow subsequently through both following working machines 2*b* and 2*c*. All three working machines 2*a*, 2*b*, 2*c* are coupled with each other mechanically in a rigid manner and are directly attached to one another, so that the system 1 basically comprises a connected tubular module. The assembled module can be lowered as a whole through the bore hole 50 into the respectively assigned position. The system 1 is positioned and fixed within the bore hole 50 by means of lateral guides.

FIG. 4 shows a sectional view of the front end of the system 1. In FIG. 4, in the front end of the system 1, the first working machine 2*a* is depicted according to the embodiment of the working machine 2*a* shown in FIG. 1, with a front inlet 13, the carrier shafts 35, 25 and the transport elements 22, 32 designed as worm threads. The worm threads 22, 32 are installed in the housing 12 and transport the medium to be conveyed through the outlet 14*a* to an inlet 13*b* of the following second working machine 2*b* that is arranged downstream, of which only the housing 10*b* is depicted without the drives and the transport elements. From the outlet 14*a*, the medium is transported along the outside of the housing 10*a* through an annular passage, which is formed by a connecting element 40*a* arranged on the outside, to the inlet 13*b*. The connecting element 40*a* connects the working machine 2*a* to the second working machine 2*b* hydraulically as well as mechanically. As an alternative to conveying the medium flow along the outside, it is possible to provide for an outlet channel and a corresponding inlet channel inside the housing, so that a straight and smooth outer contour of the mutually connected working machines 2*a*, 2*b*, 2*c* with the integrated drives 3*a*, 3*b*, 3*c* can be achieved.

From the second working machine 2*b*, the medium to be conveyed flows through the second outlet 14*b* to the inlet 13*c* of the third working machine 2*c*. These two working machines 2*b*, 2*c* are likewise mechanically and hydraulically coupled with each other by the connecting element 40*b*. It is important to note that the hydraulic drives in the drive housings 11 with the gears 21, 22 are hydraulically decoupled from the medium to be conveyed. The supply with hydraulic fluid for the hydraulic engines 3*a*, 3*b*, 3*c* is accomplished via the supply line 60, which is arranged in the front sides of the respective system parts or module parts. In case of a configuration of the drives 3 as hydraulic engines, the feed line with the inlet channel 15 as well as the return line with the outlet channel 16 are arranged or configured inside the supply line 60. In case of a configuration with electric motors, the cables are arranged inside the supply line 60 that can be configured as a direct channel. In case of a cylindrical housing design, it is possible, in a configuration of the working machines as screw spindle pumps, to make provision for a supply line 60 or multiple supply lines 60 to be arranged in the area that is beside the screw spindles, to the right and to the left of the plane in which the axles of the carrier shafts 25, 35 are placed.

Through the supply line 60 or the supply channel, which may be arranged on both sides of the plane that is formed by the axles of the carrier shafts 25, 35, the drives 3*a*, 3*b*, 3*c* may be connected in parallel to each other in regard to the power supply system 5, so that an overall self-synchronizing system can be realized, which consists of the drives 3*a*, 3*b*, 3*c* connected in parallel, and the working machines 2*a*, 2*b*, 2*c*, designed as screw spindle pumps, connected in series. Even in case of multiple-shaft embodiments, it is likewise possible to provide very compact, elongated and mechanically stable systems 1, which can be very advantageously used on oil production and gas extraction platforms under constricted spatial conditions. Due to the connection of the pumps in series and the connection of the drives in parallel, a self-synchronizing effect of the drives is achieved even under changing conveying conditions. Disturbing influences on the multi-step conveying process that result from the composition and compressibility of the fluid are eliminated for the most part, or at least kept within controllable limits.

The invention claimed is:

1. System for conveying a medium, the system comprising: a first working machine; and a second working machine; wherein the first and second working machines each have at least one carrier shaft with transport elements for the medium to be conveyed upon arranged on the at least one carrier shaft, and at least one drive that sets each of the respective carrier shaft in rotation, wherein the first and second working machines are connected in series, the first working machine is arranged downstream of the medium to be conveyed, a first drive is assigned to the first working machine and a second drive is assigned to the second working machine, and the first and second drives are connected in parallel with each other and connected to a common power supply system, and a driven shaft is coupled with each carrier shaft in a torsionally rigid manner, wherein each of the working machine is assigned to a bypass line in order to be able to bypass the respective working machine in the connection in series.

2. System according to claim 1, characterized in that the first working machine and the first assigned drive, are installed in a common housing.

3. System according to claim 2, characterized in that the first and second working machines are mechanically connected with each other to form a module.

4. System according to claim 2, characterized in that at least one of the working machine is designed as a positive displacement pump, in particular, as a screw spindle pump.

5. System according to claim 2, characterized in that the first or second drive is designed as a hydraulic engine or an electric motor.

6. System according to claim 2, characterized in that the number of driven shafts of the first or second drive corresponds to the number of carrier shafts of the first or second working machine respectively or equals an integer multiple of them.

7. System according to claim 2, characterized in that the first or second working machine has multiple carrier shafts and a respective first or second drive has multiple driven shafts, each of which is coupled with a carrier shaft.

8. System according to claim 2, characterized in that the first or second working machine has multiple carrier shafts that are coupled with each other in an angle-dependent and rigid manner.

9. System according to claim 1, characterized in that the first and second working machines are mechanically connected with each other to form a module.

10. System according to claim 9, characterized in that the first working machine is connected with the second working machine by way of connecting elements, which connect an outlet of the first working machine with an inlet of the second working machine and the second working machine is downstream of the first working machine.

11. System according to claim 1, characterized in that at least one working machine is designed as a positive displacement pump, in particular, as a screw spindle pump.

12. System according to claim 1, characterized in that the first or second drive is designed as a hydraulic engine or an electric motor.

13. System according to claim 12, characterized in that the hydraulic engine is designed as a gear motor or a screw spindle motor.

14. System according to claim 1, characterized in that the number of driven shafts of the first or second drive corresponds to the number of carrier shafts of the first or second working machine respectively or equals an integer multiple of them.

15. System according to claim 1, characterized in that the first or second working machine has multiple carrier shafts and a respective first or second drive has multiple driven shafts, each of which is coupled with a carrier shaft.

16. System according to claim 1, characterized in that the first or second working machine has multiple carrier shafts that are coupled with each other in an angle-dependent and rigid manner.

17. System according to claim 1, characterized in that the first or second drive and the respective first or second working machine are hydraulically decoupled from each other.

18. System according to claim 1, characterized in that a supply line for the first or second drives is integrated in a respective drive housing.

* * * * *